US007216372B2

(12) United States Patent
Fernandez Mateu

(10) Patent No.: US 7,216,372 B2
(45) Date of Patent: May 15, 2007

(54) DISPOSABLE PROTECTOR FOR THE SEAT RING OR UPPER PART OF A TOILET

(76) Inventor: Albert Fernandez Mateu, deceased, late of Sant Feliu de Guixols (ES); by Raquel Fernandez Escortell, legal representative, C/Paisos Catalans, 28, 5°,1°, Salt (Girona) (ES) 17190

( * ) Notice: Subject to any disclaimer, the term of this patent is extended or adjusted under 35 U.S.C. 154(b) by 0 days.

(21) Appl. No.: 10/534,847

(22) PCT Filed: Nov. 14, 2003

(86) PCT No.: PCT/ES03/00579

§ 371 (c)(1),
(2), (4) Date: Nov. 4, 2005

(87) PCT Pub. No.: WO2004/045356

PCT Pub. Date: Jun. 3, 2004

(65) Prior Publication Data

US 2006/0053540 A1 Mar. 16, 2006

(30) Foreign Application Priority Data

Nov. 19, 2002 (ES) ..... 200202786 U

(51) Int. Cl.
*A47K 13/14* (2006.01)

(52) U.S. Cl. ..... 4/245.6; 4/245.2; 4/245.1; 4/244.3; 4/245.4; 4/245.7

(58) Field of Classification Search ..... 4/245.1–245.9, 4/244.1–244.3, 235, 237, 239, 901, 571.1, 4/572.1, 243.1, 243.2, 243.3
See application file for complete search history.

(56) References Cited

U.S. PATENT DOCUMENTS

| | | | | |
|---|---|---|---|---|
| 1,170,498 | A * | 2/1916 | Klein | 4/244.3 |
| 2,251,732 | A * | 8/1941 | Earle | 4/245.9 |
| 3,331,085 | A * | 7/1967 | Potosky | 4/245.7 |
| 3,816,234 | A * | 6/1974 | Winfield | 428/317.9 |
| 4,928,328 | A * | 5/1990 | Davis | 4/420 |
| 5,729,838 | A * | 3/1998 | Schweizer | 4/245.8 |
| 5,974,594 | A * | 11/1999 | Schweizer | 4/245.8 |
| 6,813,784 | B1 * | 11/2004 | Thompson | 4/245.1 |

FOREIGN PATENT DOCUMENTS

| | | | |
|---|---|---|---|
| ES | 1 000 594 | 3/1988 | |
| ES | 1 016 953 | 12/1991 | |
| FR | 2683989 A1 * | 5/1993 | 4/245.5 |
| FR | 2 815 841 | 5/2002 | |
| WO | WO 88/01844 | 3/1988 | |

* cited by examiner

*Primary Examiner*—Khoa D. Huynh
(74) *Attorney, Agent, or Firm*—Richard M. Goldberg

(57) ABSTRACT

A disposable protector for the seat ring or upper part of a toilet, is configured to protect the sides and front part of the toilet. The protector includes one piece which covers the ring of the toilet seat or, in the absence of a seat, the upper end of the toilet, thereby protecting the user in relation to toilet.

1 Claim, 1 Drawing Sheet

DISPOSABLE PROTECTOR FOR THE SEAT RING OR UPPER PART OF A TOILET

AIM OF THE INVENTION

This Utility Model relates to a disposable protector for the seat ring or upper part of a toilet.

BACKGROUND OF THE INVENTION

The problem everyone has when using a public toilet is well known, as generally the seat ring or the actual upper part of the toilet has drops of urine left by the previous user.

These circumstances mean that people cannot use the toilet because it does not fulfil the minimum conditions of hygiene.

This problem is even greater the more the toilet is used, for example, in bars, airports and generally in all places of public use.

DESCRIPTION OF THE INVENTION

The aim of the invention when it is used solves the afore-mentioned problem because not only does it protect the ring or upper part of the toilet, but it also protects the sides and front thereof, creating total protection for the user in relation to the toilet when sitting on said toilet. Moreover, this protection also exists for the person who uses next the toilet since this person will find the toilet in optimum conditions of hygiene, even though this individual will also use a new identical protector, since it is disposable. According to the invention, the protector consists of a body that virtually covers the ring at the front and at the sides, and covers as well the front and the sides of the toilet in a strip parallel to the contour of the ring. The part determining the protector is sandwich-like, because between two layers of cellulose there is a fine layer of plastic, which makes the top layer thereof, on which the user sits, waterproof.

The user's skin, when sitting on the toilet, is in contact with a fine layer of multi-perforated cellulose so that it does not adhere to the skin.

Logically, the protector as a piece, has weakening lines that determine folding the sides and front of the protector downwards.

The protector is fixed in position on the ring by means of bands or strips of adhesive material.

DESCRIPTION OF A PRACTICAL EMBODIMENT OF THE INVENTION

Figure 1:
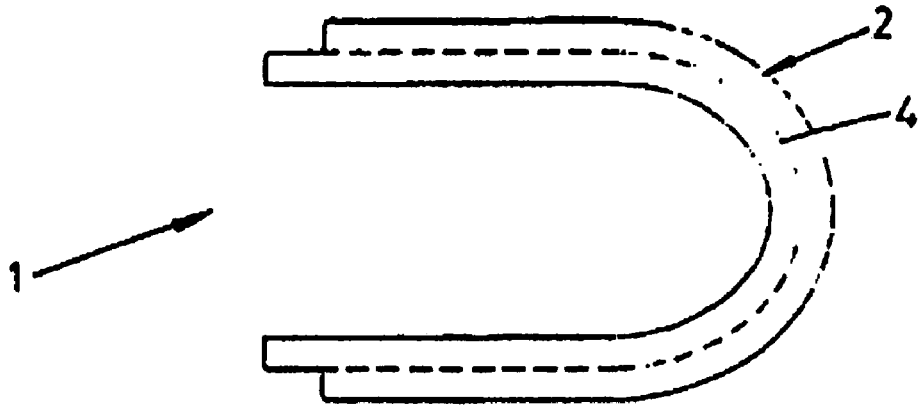
FIG. 1 shows a plan view of the protector of the invention.
Figure 2:
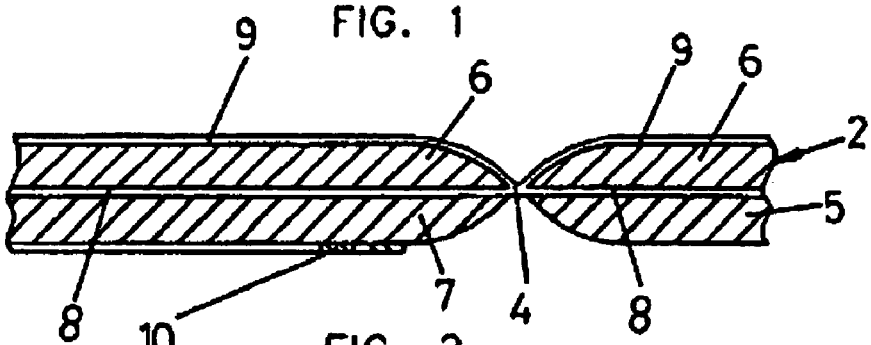
FIG. 2 shows a sectioned view of the protector.
Figure 3:
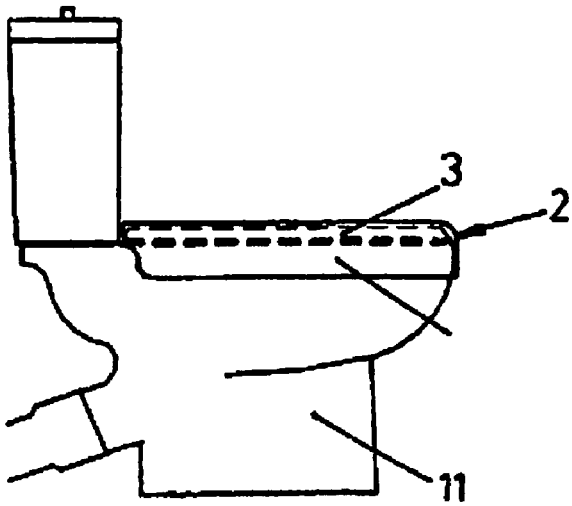
FIG. 3 shows a side view of the protector positioned on the toilet seat.

The protector 1 is made up of a piece 2 that covers the ring 3 of the toilet seat or simply the ring of the actual toilet as a top external part thereof, in the absence of a seat.

Preferably piece 2 covers the ring 3 except for the rear part thereof.

Piece 2 has a weakening line 4 by means of which the front part and side parts 5 may be folded.

Piece 2, in section, has a sandwich-like configuration because it contains two layers 6 and 7 of cellulose and between these there is a fine plastic sheet 8.

On layer 6 there is provided a very fine, multi-perforated layer 9, which is the one that is in contact with the user's skin.

Layer 7, on its lower surface, has respective bands 10 of adhesive material for attaching the protector to the seat or toilet 11 ring.

The protector is to be provided inside a fine plastic bag and moreover fine plastic gloves will be provided for use, whereby the bag is to be used to protect the toilet seat and the gloves are for handling the protector to both position it and remove it once used. In this case, and once the protector has been used, it is to be placed inside the bag together with the gloves and the ensemble is to be placed in a bin or appropriate container.

Having sufficiently described the nature of the invention, as well as the way of putting it into practice, it must be noted that the details of the arrangements indicated above and shown in the attached drawings, can be modified providing they do not alter the basic principle.

The invention claimed is:

1. A disposable protector of a substantially U-shape for a seat ring of a toilet, comprising:

a sandwich-like piece including:

an upper layer of cellulosic material and having a thickness, a lower layer of cellulosic material and having a thickness, and a thin sheet of plastic material between the two layers, the thin sheet having a thickness much less than the thicknesses of the two layers, the upper layer and the lower layer reducing in thickness and converging at a reduced thickness line defining a central weakening line along the substantially U-shape and along which a part of the piece is adapted to be folded and adapted to cover front and side areas of the toilet next to the seat ring;

a top layer on an upper side of the sandwich-like piece, the top layer being a thin multi-perforated, layer which is adapted to contact with a user's skin; and a lower layer of cellulose on a lower side of the sandwich-like piece, the lower layer having adhesive material to attach the piece to the seat ring.

* * * * *